US006863099B2

(12) United States Patent
Watkins

(10) Patent No.: US 6,863,099 B2
(45) Date of Patent: Mar. 8, 2005

(54) FUNNEL ASSEMBLY FOR VEHICLES

(75) Inventor: Kirk W. Watkins, Alpharetta, GA (US)

(73) Assignee: Paraphase, Inc., Atlanta, GA (US)

( * ) Notice: Subject to any disclaimer, the term of this patent is extended or adjusted under 35 U.S.C. 154(b) by 60 days.

(21) Appl. No.: 10/264,719

(22) Filed: Oct. 4, 2002

(65) Prior Publication Data

US 2003/0075240 A1 Apr. 24, 2003

Related U.S. Application Data

(60) Provisional application No. 60/327,247, filed on Oct. 5, 2001, and provisional application No. 60/352,312, filed on Jan. 28, 2002.

(51) Int. Cl.[7] ..... B65B 39/00; B67C 11/04

(52) U.S. Cl. ..... 141/345; 141/340; 141/344

(58) Field of Search ..... 141/331–345, 141/297; 222/548, 460; 220/86.2, 334, 366; 184/92, 105.1, 88.1, 1.5; 123/196 R, 198 E

(56) References Cited

U.S. PATENT DOCUMENTS

| | | | | | |
|---|---|---|---|---|---|
| 4,140,160 | A | | 2/1979 | Glackin | 141/332 |
| 4,697,670 | A | | 10/1987 | Arruda | 184/1.5 |
| 4,703,867 | A | | 11/1987 | Schoenhard | 220/85 F |
| 4,896,746 | A | * | 1/1990 | Desjardins | 184/92 |
| 5,101,869 | A | * | 4/1992 | Myers | 141/339 |
| 5,228,488 | A | * | 7/1993 | Fletcher | 141/331 |
| 5,316,059 | A | | 5/1994 | Lahnan et al. | 141/340 |
| 5,349,995 | A | * | 9/1994 | Perez | 141/98 |
| 5,472,025 | A | | 12/1995 | Conrad et al. | 141/332 |
| 5,547,099 | A | * | 8/1996 | Chang | 220/212.5 |
| 5,584,238 | A | | 12/1996 | Newton, Sr. | 99/495 |
| 5,685,351 | A | * | 11/1997 | Kazarian et al. | 141/325 |
| 5,931,206 | A | * | 8/1999 | Simdon et al. | 141/312 |
| 6,116,299 | A | * | 9/2000 | Cummins et al. | 141/332 |

* cited by examiner

*Primary Examiner*—Timothy L. Maust
(74) *Attorney, Agent, or Firm*—Womble Carlyle Sandridge & Rice, PLLC

(57) ABSTRACT

A funnel assembly to be mounted on a fluid intake pipe such as for a vehicle engine includes a funnel body connected to a valve that is in communication with the intake pipe. The funnel body is moveable between an operative position in which the valve is opened for receiving a fluid flow and directing the flow into the fluid intake pipe, and a non-operative position for closing the valve.

11 Claims, 9 Drawing Sheets

FUNNEL ASSEMBLY FOR VEHICLES

CROSS-REFERENCE TO RELATED APPLICATIONS

The present application claims the benefit of U.S. Provisional Application Ser. No. 60/327,247, filed Oct. 5, 2001, and U.S. Provisional Application Ser. No. 60/352,312, filed Jan. 28, 2002.

FIELD OF THE INVENTION

The present invention generally relates to systems for the input or delivery of fluids, and in particular, relates to a funnel assembly that is connected to a fluid intake through which oil or other fluids are supplied to the engine of a vehicle.

BACKGROUND OF THE INVENTION

For the general maintenance of engines, and in particular engines for vehicles such as automobiles, boats, etc., fluids such as oil, transmission and brake fluids, antifreeze and washer fluid generally must be routinely changed and added. Such fluids typically are added to a fluid reservoir by the removal of a cap or seal and simply pouring the fluid into an intake such as an intake pipe. The application or input of these fluids is often a messy operation and frequently results in the fluids being spilled or dripped on or down the outside of the intake pipe and/or onto adjacent engine components where the collection of such fluids can help contribute to a buildup of grease, dust, etc. on or around engine components. In addition, such dripped or spilled fluids, and any dirt and debris collected thereon, can be burned or at least partially combusted as the engine components are heated during operation of the engine. This often results in unpleasant smells or odors outside the vehicle, which odors also can be directed into the passenger compartment as the vehicle is driven. In some cases, such a buildup can lead to conditions that are more dangerous, such as fire and/or engine damage. Spilled fluids can also stain driveways or parking spaces, and contribute to pollution.

Further, even though it is generally advised to use a funnel for adding fluids such as oil into an engine, people often forget or neglect to use a funnel, especially given the new bottle type containers that claim to make it easier to pour or add such fluids to fluid intakes. In addition, there are many occasions, such as while traveling, where the vehicle operator will not have a funnel available; or where the design of the engine itself may make it difficult to use or properly seat the funnel on the opening of the inlet or fluid intake, such as, for example, cars where the fluid intake is positioned at an angle of 45° or less with respect to the engine or which have a very limited space in their engine compartment. Such space limitations and varying engine designs also tend to make it difficult to reach or deliver the fluids cleanly and easily to the fluid intake without spills or drips. In addition, care must still be taken when using a funnel to ensure that the fluids contained therein have been substantially drained prior to the removal of the funnel from the fluid intake pipe, and even then, the user must often try to manipulate a rag, etc. below the spout of the funnel as it is removed from the fluid intake pipe to avoid excess fluids dripping therefrom.

Accordingly, it can be seen that a need exists for a funnel assembly that addresses these and other related problems in the art.

SUMMARY OF THE INVENTION

Briefly described the present invention, generally relates to a funnel assembly for delivery or input of fluids to a fluid reservoir or intake, generally for an engine of a vehicle. The funnel assembly includes a funnel body generally formed from a corrosion resistant, nonstick material such as plastics, composite materials and/or metals. The funnel body is typically attached to an inlet for the fluid intake and includes a first or distal end and a second or proximal end at a downstream end of such funnel body adjacent the fluid intake. The funnel body further includes side walls generally having a sloped configuration so as to define a fluid receiving area in which a fluid is received and directed toward the inlet of the fluid intake. The funnel body also generally is pivotally mounted adjacent the inlet of the fluid intake to enable movement of the funnel body between a non-operative position enveloping the inlet of the fluid intake and an operative or open position for receiving and directing the fluids to the inlet of the fluid intake. A valve generally is mounted adjacent the downstream or second end of the funnel body, defining a valve opening in the funnel body. The valve is in communication with the inlet of the fluid intake for enabling passage of fluid into the inlet of the fluid intake upon movement of the funnel body to its opened position and for closing the inlet of the fluid intake upon movement of the funnel body to closed position.

Various objects, features and advantages of the present invention will become apparent to those skilled in the art upon review of the following detailed description, when taken in conjunction with the accompanying drawings.

DESCRIPTIONS OF DRAWINGS

DETAILED DESCRIPTION OF INVENTION

Figure 1:
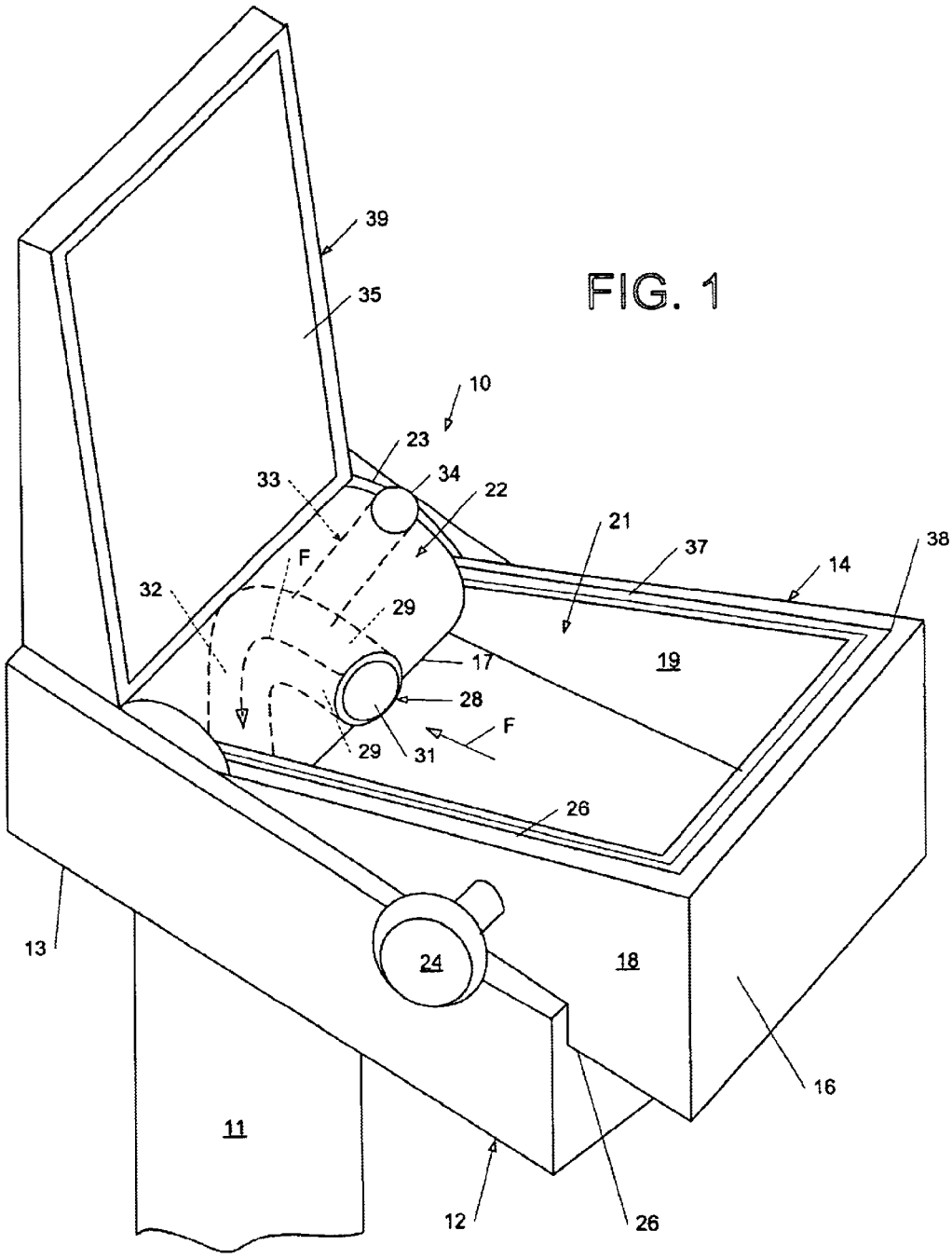
FIG. 1 is a plan view illustrating a first embodiment of the present invention.

Referring now to the drawings in which like numerals indicate like parts through the several used, FIGS. 1A–6B illustrate various embodiments of the funnel assembly 10, 50, 80, 100 of the present invention which is adapted to be seated or mounted on or is formed as a part of an inlet portion for a fluid intake pipe 11 for an engine, such as an oil intake pipe, for the delivery of fluids, such as oil, antifreeze, washer fluid, transmission fluid, power steering fluid, brake fluid, etc., for delivering such fluids to the engine.

Figure 2A:
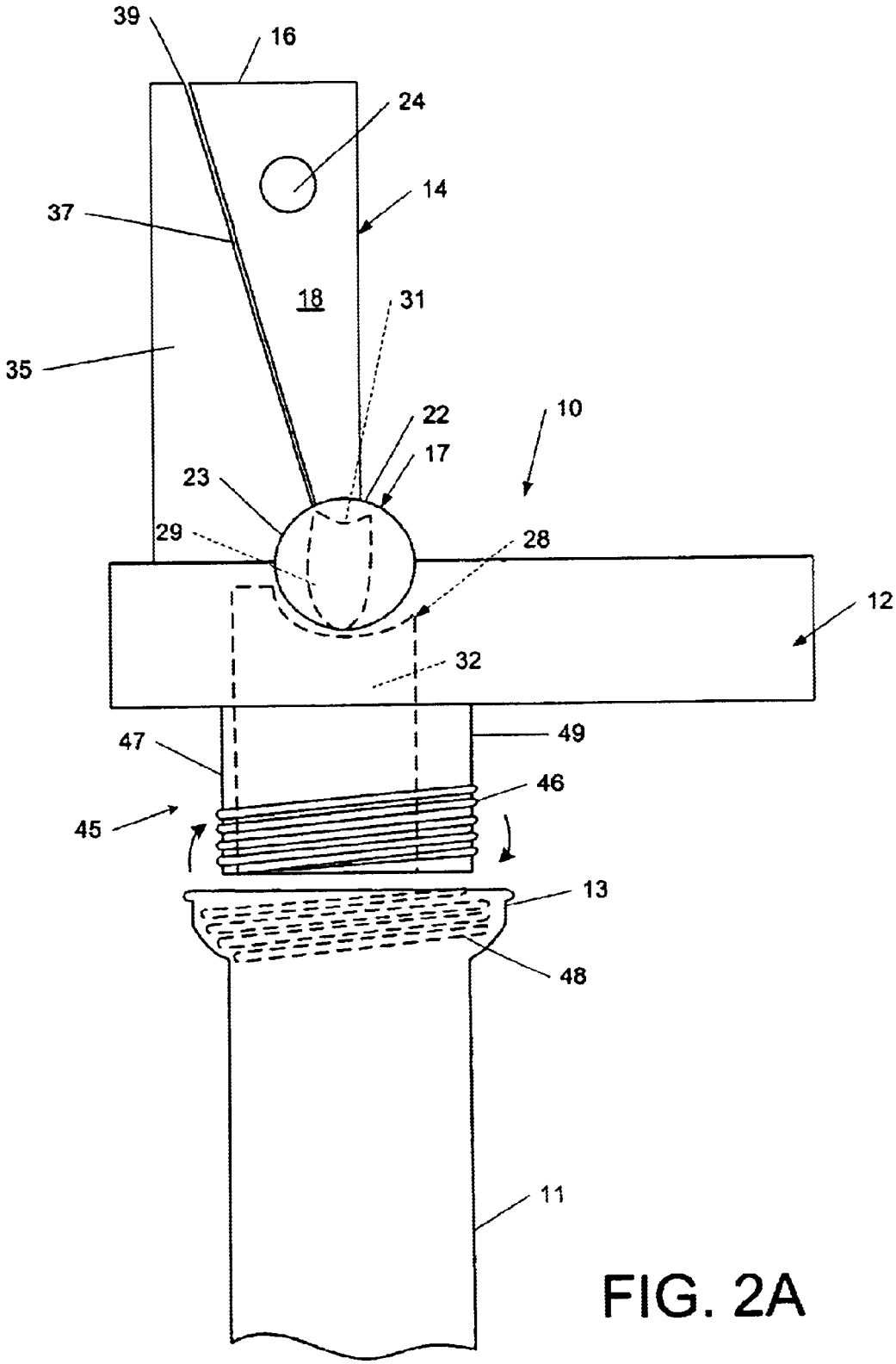
FIG. 2A is a side elevational view, with parts broken away, of the funnel assembly of FIG. 1 mounted on a fluid intake pipe.
Figure 2B:
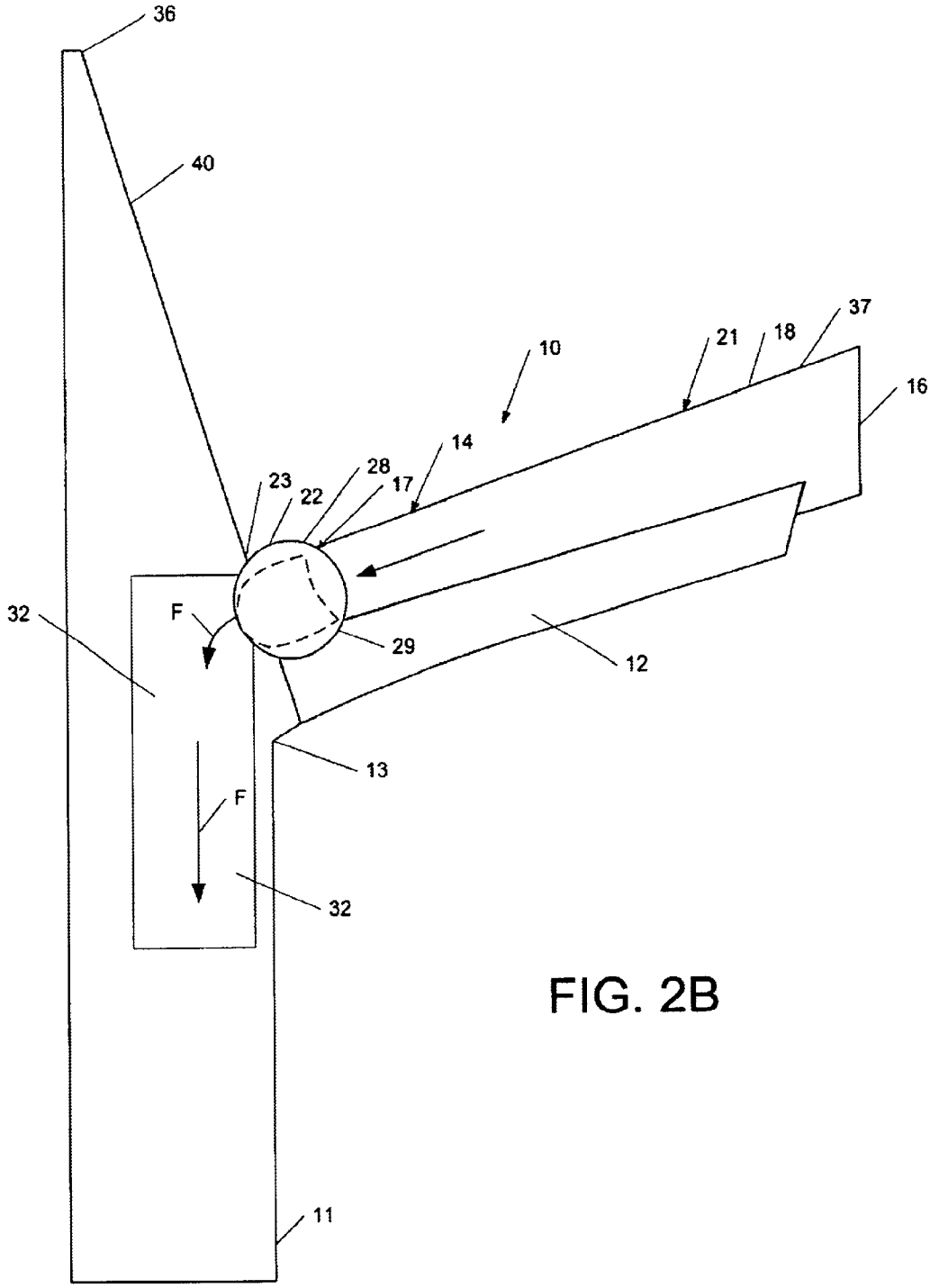
FIG. 2B is a side view with parts broken away illustrating the funnel assembly of the FIG. 1 in an open position.

As generally illustrated in FIGS. 1–2B, in a first embodiment of the funnel assembly 10 of the present invention, the funnel assembly generally includes a base 12 mounted to the inlet 12 of the intake pipe 11, and a funnel body 14 having a first upstream or distal end 16, a second, downstream or proximal end 17 and side walls 18 and 19 defining a fluid receiving area or channel 21. The base 12 and funnel body 14 generally will be formed from a molded, high strength, temperature and corrosion resistant material including various plastic, metal or other composite or synthetic materials, such as used for the fluid intake pipe 11. As illustrated in FIGS. 1A–2B, the funnel body 14 also generally has a sloped and/or tapering configuration, with its first, distal, or upstream end 16 being slightly taller or greater in size than its downstream or second end 17.

Typically, the downstream end 17 of the funnel body will be formed with or terminate at a rounded protrusion or pivot member 22, which generally is received within slots or pivot recesses 23 formed in the base 12 or within the intake pipe 11 as illustrated in FIG. 2B. A tab or other type of handle 24 further generally is formed along or attached to one side wall 18 of the funnel body for enabling the funnel body to be moved or pivoted between a closed position as shown in FIG. 2A, to an open position as shown in FIGS. 1 and 2B. As shown in FIGS. 1 and 2B, the base 12 can be integrally formed with, or otherwise mounted along or about the intake pipe 11 and typically projects outwardly from one side of the intake pipe adjacent the second end 17 of the funnel body. The base can also include a recess 26 for receiving the funnel body 14 therein and acts as a stop and support for the funnel body when it is lowered to its open, operative position as shown in FIGS. 1 and 2B.

As indicated in FIGS. 1–2B, a valve 28 typically is positioned at the downstream or second end 17 of the funnel body 14 extending between the funnel body and the intake pipe. The valve 28 generally includes a first or intake portion, shown in dashed lines 29 in FIGS. 1 and 2A, that is formed in pivot member 22 and defines a valve opening or hole 31 through which the fluid flowing along the funnel body is directed into the inlet 13, and a second, receiving portion 32 inside the base 12 (FIG. 2A) or within the intake pipe 11 (FIG. 2B), defining a fluid passage into the intake pipe. When the funnel body is moved to its open operative position as shown in FIGS. 1 and 2B, the intake and receiving portions, 29 and 32, are aligned so that the valve 28 is opened to receive fluid into the intake pipe as shown by arrows F. An air passage (FIG. 1) further generally is defined through pivot member 22, extending from an inlet opening 34 to the valve 28 so that air can be supplied to the valve when opened to facilitate the fluid flow therethrough.

In addition, a stop plate 35 or cover can be mounted to the base 12 in an upstanding attitude to provide a surface against which the funnel body can be closed as shown in FIG. 2A. Alternatively, the funnel body can be closed against an upper portion 36 of the intake pipe 11, as depicted in FIG. 2B. A lip 37 typically is formed about the side walls 18 and 19 and first end 16 of the valve body 12 and defines an edge for the fluid received on the funnel body and generally helps prevent leaks from the side of the funnel body when in its raised, non-operative position, closed against the stop plate 35 (FIG. 2A) or upper portion 36 (FIG. 2B) of intake pipe 11. Still further, a gasket, typically formed from a sealing material such as a rubberized material or other similar, alternative material, can be applied along or about the lip 37, such as indicated at 38 in FIG. 1 so as to form a substantially air-tight seal with the lip of the stop plate 35, or side edge (FIG. 2B) of the upper portion of the intake pipe to prevent leaks into or out of the fluid intake.

Figure 3A:
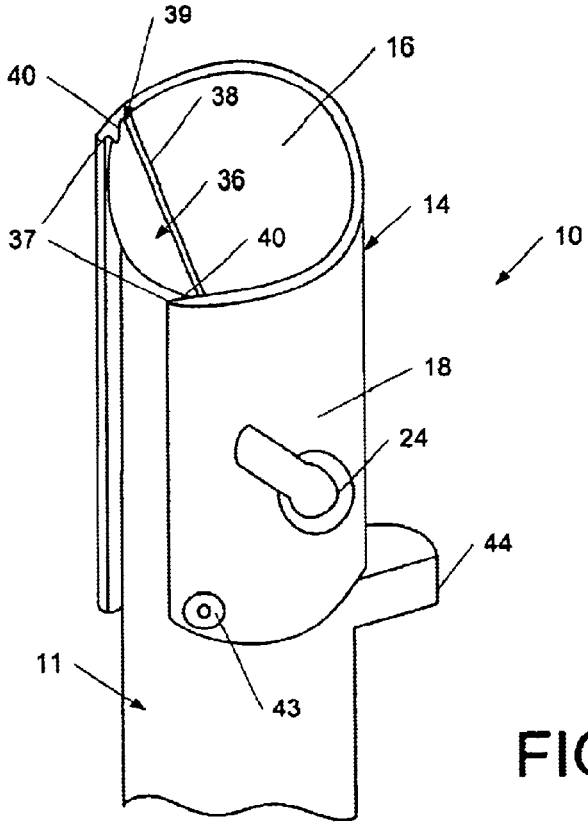
FIG. 3A is a perspective view of an example latching mechanism for the funnel assembly of FIG. 1 of the present invention.
Figure 3B:
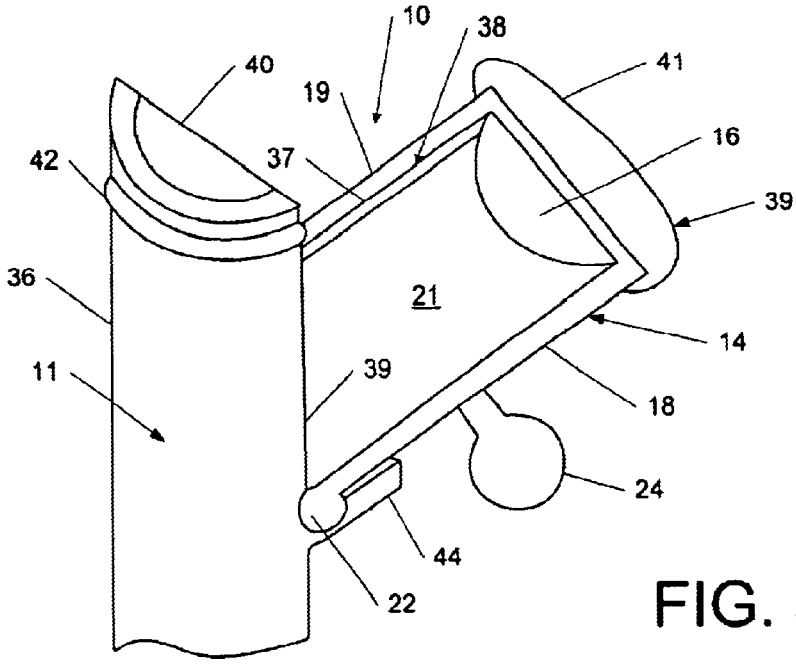
FIG. 3B is a perspective illustration of an example latching mechanism for the funnel assembly of the present invention as shown in FIG. 1.

Additionally, a closure or latching mechanism 39 can be provided for securing the funnel body in its closed, non-operative position. FIG. 3B illustrates an alternative closure mechanism 39 in which a sealing ring or clip 41 is pivotally attached adjacent the first end 13 of the funnel body. The sealing ring 41 generally is pivotable over the upper portion 36 of the intake pipe 11 from a non-engaging to an engaging position, snapped into engagement with a locking recess or with a protrusion 42 formed about the intake pipe as indicated in FIG. 3B. The engagement of the sealing ring against the intake pipe tends to pull and hold the funnel body against the intake pipe so as to form a tight, locking seal between the intake pipe and funnel body. Other types of closure mechanisms, such as applying a screw or snap-fit type top or cap over the top of the funnel body and fluid intake pipe, or the use of other types of latching or locking mechanisms also can be used in the present invention. FIG. 3A further alternatively illustrates the use of a hinge pin 43 in place of the pivot member for the pivotal attachment of the funnel body to the fluid intake pipe. Still further, FIGS. 3A and 3B show the use of a brace or stop 44 in place of a base 12 as shown in FIGS. 1–2B. The stop 44 provides support with limited surface area so as to reduce the potential for interference by the brace or stop.

Typically, as shown in FIGS. 1, 2B–4B, the funnel assembly 10 will be integrally formed with or mounted to the intake pipe 11. It will, however, be understood that, where space permits, the funnel assembly 10 can be formed as an extension or replacement pipe or cap that could be used in place of the existing fluid intake pipe cap, for example for an oil intake, for use in retro-fit type applications, as indicated in FIG. 2A. In such applications, the funnel assembly 10 generally will include a coupling connector 45, typically formed as a pipe of corresponding size to that of the fluid intake pipe 11. The connector further generally will have threads 46 formed about a lower portion 47 of the connector for engaging threads 48 of the fluid intake pipe for mounting the funnel assembly on the fluid intake pipe. This connector 45 further can include an upper portion 49 attached to the base 12 of the funnel assembly 10 and connected to lower portion 47 in such a manner as to be independently rotatable with respect to the lower portion so that the lower portion can be threadably attached to the intake pipe as indicated. Other mechanisms for attachment of the funnel assembly 10 to the intake pipe 11, such as a press or snap-fit type arrangement, adhesives and other similar methods also can be used.

In use of the embodiments of FIGS. 1–2A, the funnel body 14 is first released or otherwise detached from its engagement against the fluid intake pipe 11 and is pivoted outwardly and downwardly to its opened, operative position shown in FIGS. 1 and 2B. Thereafter, the user pours a fluid, such as oil, into the fluid receiving area or channel 18 of the funnel body 14, which fluid flows along the channel and through the valve opening 31, passing into and through the inlet of the fluid intake pipe. After a sufficient amount of fluid, such as oil, has been added, the user pivots the funnel body back to its raised, closed, non-operative position and locks or otherwise secures the funnel body in place against the fluid intake pipe, such as by its lip engaging a corresponding lip or ridge formed along the intake pipe, or by the engagement of another closure mechanism such as a snap ring, latch or threaded connector. Any remaining fluid such as oil on the funnel body will further tend to drain downwardly and collect at the bottom of the funnel assembly, adjacent the valve, and will be collected and contained inside the funnel assembly to minimize leakage.

Figure 4A:
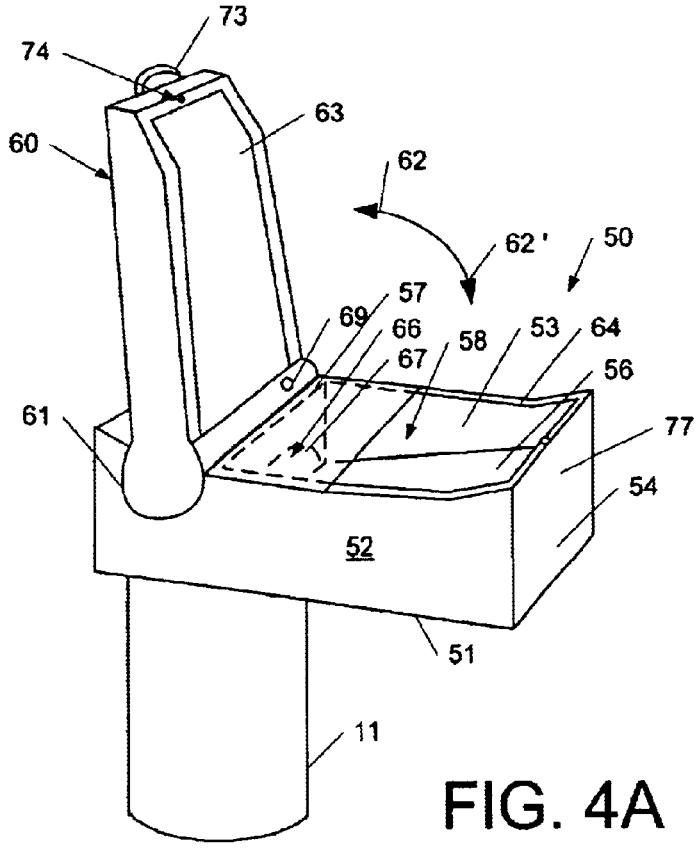
FIG. 4A is a perspective illustration of another, additional embodiment of the funnel assembly of the present invention in a operative position.
Figure 4B:
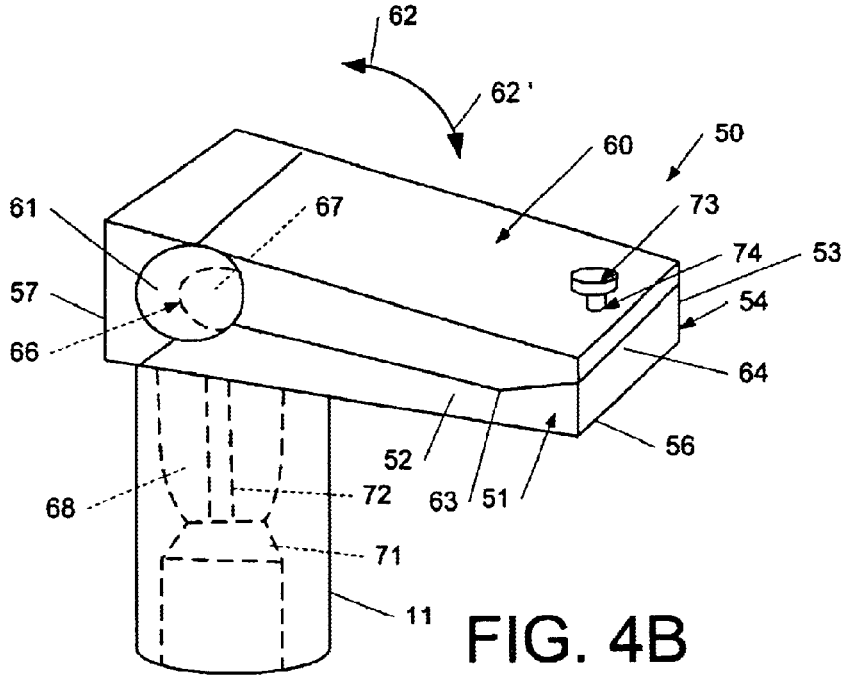
FIG 4B is a perspective illustration of another, additional embodiment of the funnel asssembly of the present invention in a non-operative position.

FIGS. 4A and 4B illustrate a further example embodiment 50 of the funnel assembly of the funnel assembly of the present invention. In this alternative embodiment, a funnel assembly 50 generally includes a base 51 mounted over the inlet 13 of an intake pipe 11. The base generally will be formed from a durable, corrosion resistant material such as various types of plastics and composite materials, as well as metals such as aluminum. In this embodiment 50, the base 51 generally will be formed with a pair of substantially parallel sidewalls 52 and 53, a first or distal end 54, and a sloping floor or bottom 56 that slopes downwardly from the distal end 54 to a proximal or second end 57 of the base, positioned above the intake of the inlet pipe, and defines a fluid receiving channel or area 58. The sloping configuration of the bottom of the base generally guides or directs a fluid flow F downwardly toward the intake of the inlet pipe.

As indicated in FIGS. 4A and 4B, a pivoting closing member or cover 60 is pivotally attached to the base 51 by a protrusion, pivot member or hinge, indicated at 61, so that the cover is movable in the direction of arrows 62 and 62' from a lowered, closed or covering position indicated in FIG. 4B, to a raised, open position shown in FIG. 4A to enable operation or use of the funnel assembly. As indicated in FIG. 4A, the cover 60 generally is of a similar size and configuration to the base 51 and includes an outer edge or rim 63, adapted to engage and bear against an upper edge 64 of the base 51 when the cover is lowered to its closed position. As discussed above, a gasket material 65 generally can be applied about the edges 63 and 64 of the cover and base to provide a substantially air tight seal when the cover is closed against the base.

A valve 66 generally is formed in the pivot member 61 of the cover and defines a valve opening or hole 67 that communicates with a valve passage, shown at dashed lines 68 in FIG. 4B, extending along the intake pipe 11. As the cover 60 is moved to its open position shown in FIG. 3A, the valve opening 67 is opened to enable passage of a fluid flow into and through the valve and into the intake pipe and along the valve passage 68. In addition, an air hole or passage 69 (FIG. 4A) also generally is provided through the pivot member 61. The air passage 69 communicates with the valve 66, so as to enable a flow of air to be directed into the valve when the valve is in an operative position when the cover has been raised to its open position as shown in FIG. 4A, to facilitate the flow of fluid therethrough.

In addition, a cover plate 70 (shown in dashed lines in FIG. 4) can be mounted over the valve opening 67, and the side walls 52 and 53 can be provided with portions or sections of an increased height so as to provide increased volume within the fluid receiving channel 58. This helps to guard against overflow of fluid from the channel 58. With such an arrangement, the cover 60 also typically will be configured so as to mate with the raised profile of the side walls 52 and 53 to ensure tight sealing contact therebetween.

As further indicated in FIG. 4B, a stopper or closing member, indicated at dashed lines 71, can be provided in the valve passage 68 formed along the intake pipe 11. The stopper or closing member 71 generally will be attached or linked to the cover or pivoting member, such as by a cable, rod or similar attachment mechanism 72, so that as the cover is raised and lowered to its open and closed positions, the stopper is moved along the fluid passage into and out of a sealing position so as to close off the fluid passage and further prevent the passage of air or debris, etc. into the and along the fluid intake pipe. A knob or handle 73 also can be mounted on the cover to facilitate opening and closing of the cover.

The cover and base also can be provided with a lock mechanism 74 (FIG. 4A), such as a ball detent or a snap lock type latch mechanism to help maintain the cover in a closed position tightly bearing against the upper edge or lip of the base when in its closed position and prevent the cover from being inadvertently dislodged or otherwise moved to its open position. Alternatively, the locking mechanism 74 can include a threaded shank or rod attached to the handle or knob 73, and which can engage a corresponding threaded recess or opening 77 (FIG. 4A) formed adjacent along the edge of the funnel body at its distal end or wall. When the cover is lowered to its closed position, the handle or knob provided therealong can be rotated, whereby as the threads of the shank engage the corresponding threads of its mating recess, the cover is drawn into a tighter, locked arrangement bearing against the upper lip of the base or funnel body to provide an inadvertent opening of the cover and facilitate the formation of a substantially airtight seal between the cover and the base or funnel body.

FIGS. 3A and 3B generally illustrate additional embodiments/examples of closure mechanisms 39 for securing the funnel body in its closed, non-operative position against a fluid intake pipe 11 as shown in FIGS. 1–2A. In one example embodiment, with the funnel body also shown as alternatively having a semi-cylindrical configuration, as shown in FIG. 3A, the lip 37 formed along the edge of the side walls of the funnel body can be engaged with a corresponding lip or ridge 40 formed along the upper portion 36 of the intake pipe. Such a ridge typically also will have a sealing material or gasket 38 applied thereto so that it can be brought into tight engaging, snapping contact with the lip 37 of the funnel body, so that such engagement forms a tight seal between the funnel body and the intake pipe.

Figure 5A:
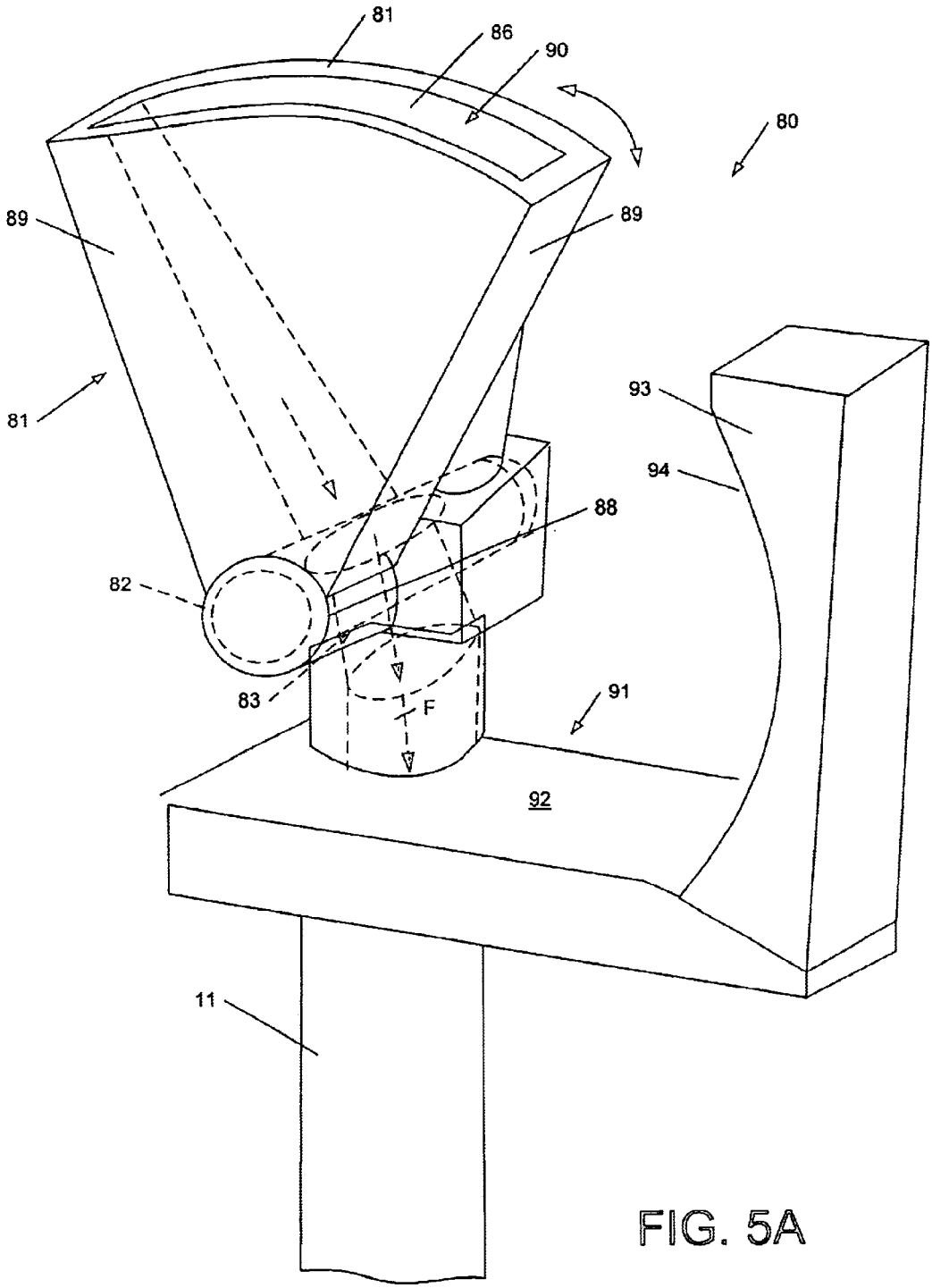
FIG. 5A is a perspective view of still a further embodiment of the funnel assembly of the present invention in a raised or operative position.
Figure 5B:
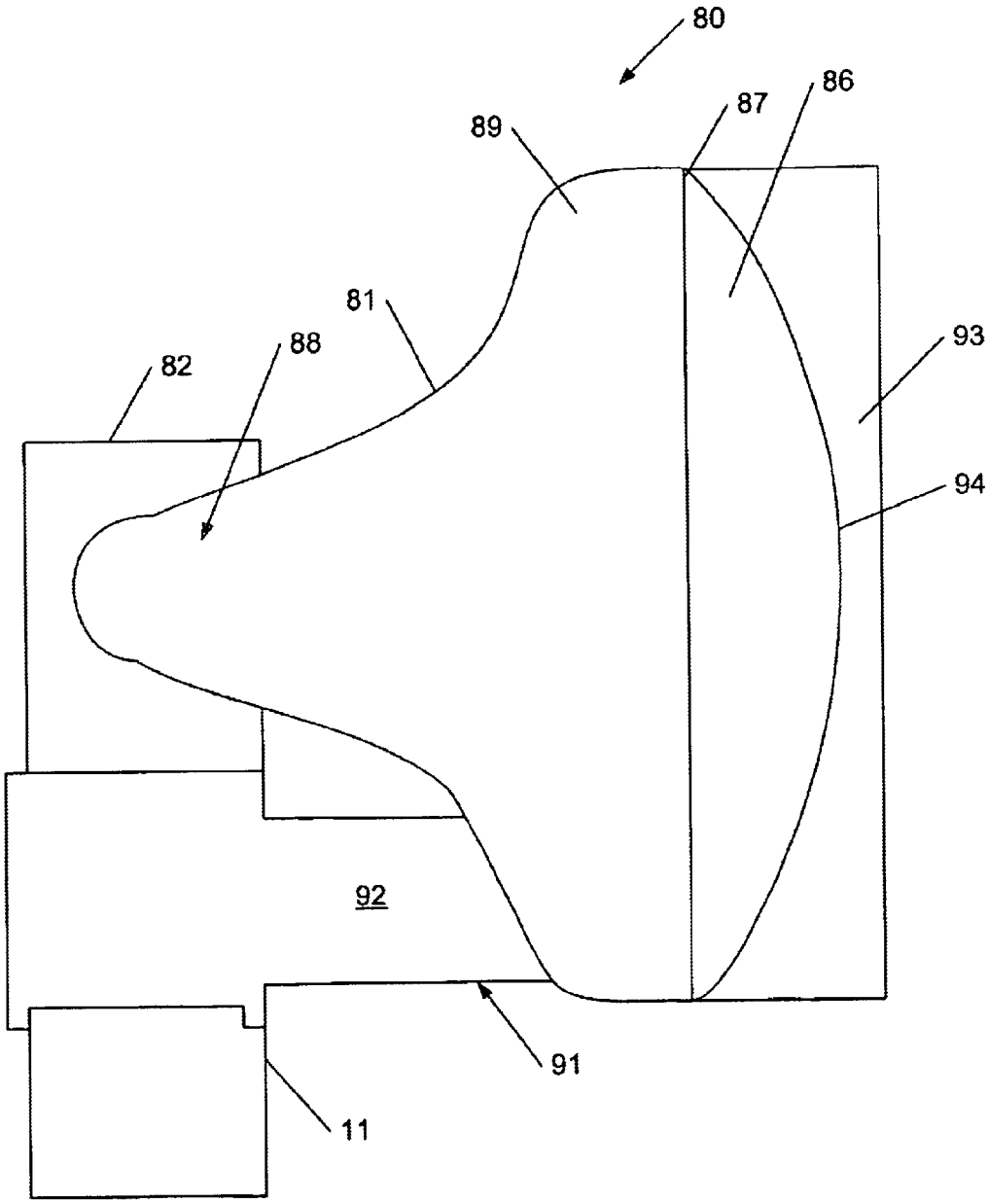
FIG. 5B is a side elevational view of the embodiment of the funnel assembly of the present invention illustrated in FIG. 5A with the funnel assembly being in its lowered, closed or non-operative position.

FIGS. 5A and 5B illustrate a further alternative embodiment of funnel assembly 80 of the present invention, having a funnel body 81 that is pivotally attached to an intake pipe 11 via pivot member or hinge 82 so as to be moveable between a raised, open position (FIG. 5A) and a closed, lowered position (FIG. 5B). The funnel assembly includes a valve 83 formed within the funnel body 81 for transmission of fluid into the intake pipe 11. The valve 83 generally defines a valve opening (shown in dashed lines 84 in FIG. 5A) through which a fluid is received and can flow into the inlet of the intake pipe 11, as shown by arrows F and which is closed as the body 81 of the funnel assembly is pivoted to a lowered, closed position, as shown in FIG. 5B. The funnel body 81 generally is formed from a high strength and temperature and corrosion resistant plastic, metal or other synthetic material and generally has an open first or upper end 86 with a curved, convex upper edge 87, a second or lower end 88 adjacent the valve 83, with side walls 89 that taper inwardly and downwardly toward the valve 83, so as to define a tapered or sloping fluid receiving area 90 along which the fluid is received and guided to the valve 83. The funnel body 81 further can be formed in a substantially cylindrical or conical configuration as a conventional funnel, having a wider upper end 86 that then tapers inwardly and downwardly toward the lower end 88 so as to channel or guide the fluid received therein toward the valve and into he fluid intake pipe.

As additionally shown in FIGS. 5A and 5B, a guard 91 typically can be mounted to the intake pipe 11 below the funnel body. The guard 91 has a base 92 attached to the intake pipe and an upstanding cap or cover 93. The base and cap support the funnel body and provide a closure for the open upper end of the funnel body when in its lowered, closed position, as shown in FIG. 5B. The lip 94 of the cap also generally is found or configured so as to collect and retain oil or other fluids that may have dripped down the side of the funnel body, and helps guard against dust and debris from passing into the funnel body. A catch-pan or an absorbent material (not shown) also can be mounted in or along the base 92 of the guard 91 for absorbing/collecting any dripped fluids. The cap further can include a gasket or sealing material between the cap and upper end of the valve body so as to help form a substantially airtight seal to prevent fluid leakage.

In use, the funnel body 81 is twisted or pivoted to its raised, upright and operative position shown in FIG. 5A, so that the open upper end 86 is exposed and the valve opening 84 is opened/exposed. A fluid, such as oil, is poured therein passing through the valve and into the fluid intake pipe. Thereafter, the user pivots the funnel body back down to its lowered configuration with the upper end 86 fitted or sealed against the cap 93 to close the funnel assembly, so that it is out of the way for storage and non-use.

Figure 6A:
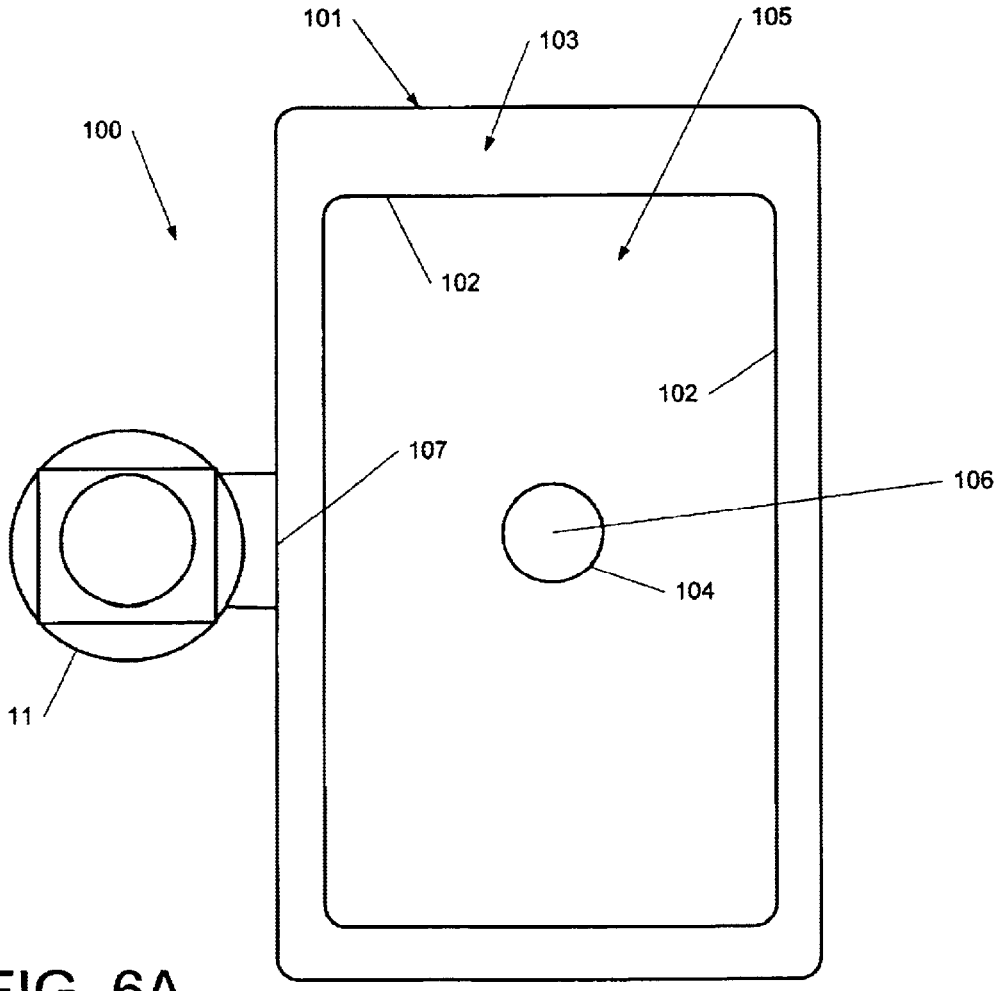
FIG. 6A is a plan view of another embodiment of the funnel assembly of the present invention in a raised or operative position.
Figure 6B:
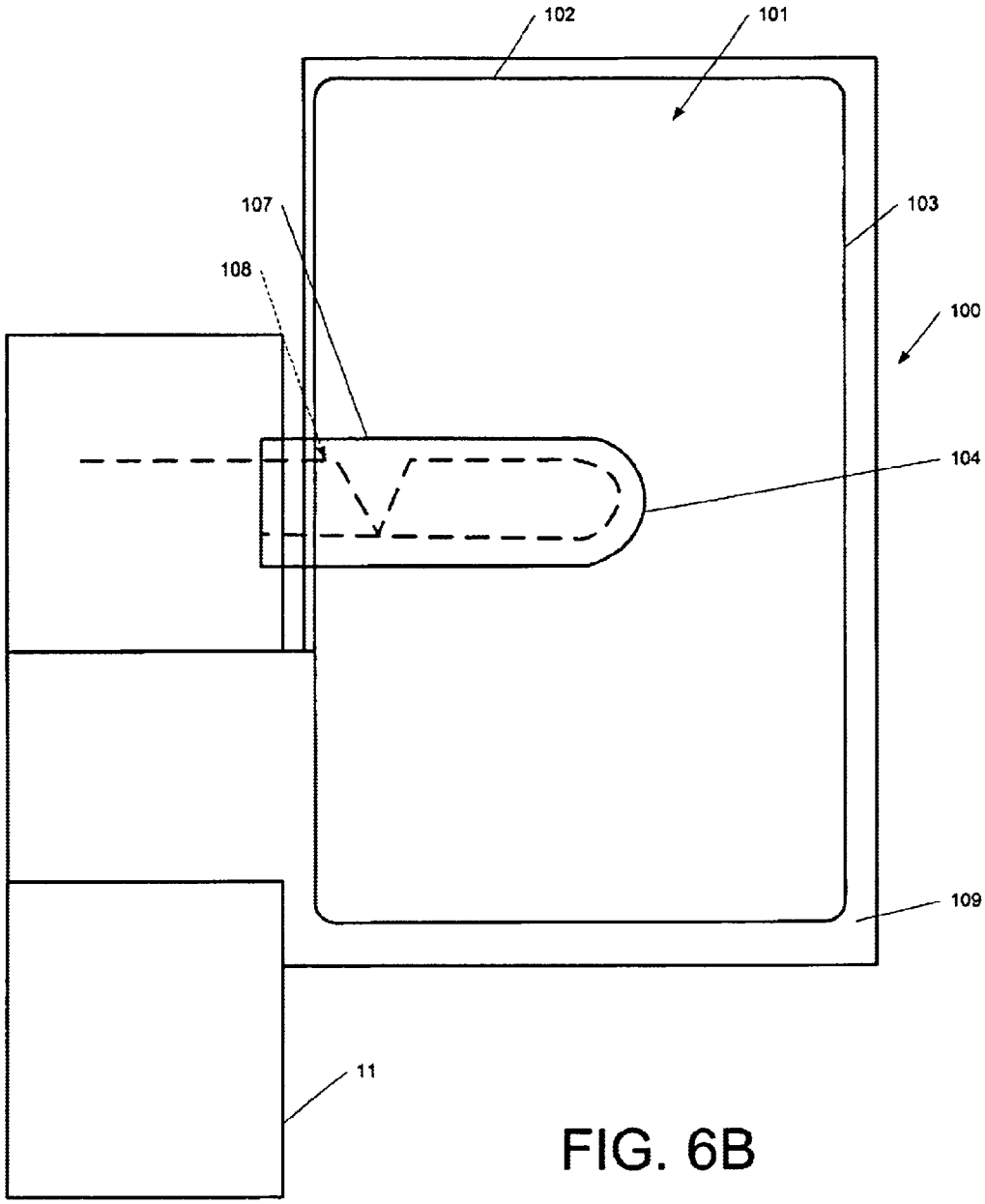
FIG. 6B is a side elevational view of the embodiment of the funnel assembly of the present invention illustrated in 6A with the funnel assembly being in its lowered, closed or non-operative position.

Still a further alternative embodiment of the funnel assembly 100 of the present invention is illustrated in FIGS. 6A and 6B. The funnel assembly 100, as with the embodiments previously discussed, generally includes a funnel body 101 typically formed from a plastic, metal or other similar high strength, temperature and corrosion resistant material. The funnel body in this embodiment generally is substantially rectangular, including a series of side walls 102 that taper inwardly and downwardly from a first or upper end 103, to a lower or second end 104, so as to define a fluid receiving area 105. A valve, shown in dashed lines 108 (FIG. 6B), opening is formed in the lowered end 104 of the valve body for release of the fluid therethrough. The funnel body 101 is pivotally attached to the intake pipe 11 via a connecting pipe 107, which generally includes a valve (shown in dashed lines 108 (FIG. 6B) between the funnel body and the fluid intake pipe. As the valve body is pivoted between its raised, open operative position (FIG. 6A) and to its lowered, closed non-operative position (FIG. 6B), the valve is opened and closed so as to enable the flow of fluid into the intake pipe or close off the intake pipe when not in use. Additionally, as with the funnel assembly 80 of FIGS. 5A and 5B, in this embodiment of the funnel assembly 100 (FIGS. 6A and 6B), a guard 109 (FIG. 6B) typically will be attached to the fluid intake pipe and extended about the funnel assembly to serve as a support and dust or dirt guard for the funnel assembly when in its lowered, non-operative position, as indicated in FIG. 6B. The guard also can serve as a cap, and further can be moveable into engaging, sealing contact with the funnel body, so as to substantially seal or close off the open upper end of the funnel body to protect it from dust and debris, without requiring a separate cap for the funnel assembly 100.

It will be understood by those skilled in the art that while the present invention has been described above with reference to preferred embodiments, various modifications, additions and changes can be made thereto without departing from the spirit and scope of the invention as set forth in the following claims.

What is claimed is:

1. A funnel assembly for delivering fluids to a fluid intake pipe, the funnel assembly comprising:

a funnel body adapted to be mounted on the fluid intake pipe and having a first end, a second end adjacent the fluid intake pipe, and a series of side walls defining a fluid receiving area for directing a flow of fluid from the first end to the second end of the funnel body;

a valve positioned between the first and second ends of the funnel body and including a valve opening adjacent the second end of the funnel body for receiving and directing the fluid flow into the valve for transmission into the fluid intake pipe; and a cover moveably attached to the funnel body and moveable between a closed position covering the fluid receiving area and closing the valve, and an open position, opening the valve to permit input of the flow of fluid into the fluid receiving area through said valve.

2. The funnel assembly of claim 1 and further including a base mounted to the fluid intake pipe and to which the funnel body is pivotally attached to enable movement of the funnel body between operative and non-operative positions.

3. The funnel assembly of claim 1 and further comprising a latch mechanism along the funnel body for securing the funnel body in a closed, non-operative position.

4. The funnel assembly of claim 1 and further comprising a connector mounted to the funnel body and adapted to be releasibly attached to the fluid intake pipe to enable mounting and removal of the funnel assembly from the fluid intake pipe.

5. The funnel assembly of claim 4 and wherein the connector comprises an upper portion and a lower portion and wherein the upper and lower portions of the connector are independently rotatable.

6. The funnel assembly of claim 1 and wherein the funnel body is formed from a corrosion resistant, nonstick material.

7. The funnel assembly of claim 1 and wherein the funnel body is pivotally mounted so as to be moveable between an operative position in which the valve is opened, a valve opening exposed for receiving the fluid flow, and a non-operative position in which the valve is closed.

8. A funnel assembly for delivery or input of fluids to a fluid reservoir for an engine, comprising:

a funnel body attached to an inlet for the fluid reservoir and including a first end, a second end and at least one side wall, defining a fluid receiving area that tapers toward said second end and in which a fluid is received and directed toward the inlet of the fluid reservoir;

a guard mounted adjacent the funnel body;

wherein said funnel body is pivotally mounted adjacent the inlet of the fluid reservoir to enable movement of said funnel body between a non-operative position engaging the guard so as to close the inlet of the fluid reservoir and an operative position for receiving and directing the fluids to the inlet of the fluid reservoir; and a valve in communication with the inlet of the fluid reservoir, positioned adjacent said second end of said funnel body and having a valve opening at said second end for enabling passage of fluid into the inlet of the fluid reservoir upon movement of said funnel body to its operative position and for closing the inlet of the fluid reservoir upon movement of said funnel body to its non-operative position.

9. The funnel assembly of claim 8 and further comprising a connector mounted to the funnel body and adapted to be releasibly attached to the inlet of the fluid reservoir to enable mounting and removal of the funnel assembly from the inlet of the fluid.

10. The funnel assembly of claim 8 and further including a base mounted to the inlet of the fluid reservoir and to which the funnel body is pivotally attached to enable movement of the funnel body between operative and non-operative positions.

11. The funnel assembly of claim 8 and further comprising a latch mechanism along the funnel body for securing the funnel body in a closed, non-operative position.

* * * * *